US008677654B2

(12) United States Patent
Aveni et al.

(10) Patent No.: US 8,677,654 B2
(45) Date of Patent: Mar. 25, 2014

(54) ARTICLE OF FOOTWEAR WITH TONGUE OF VARYING THICKNESS

(75) Inventors: Michael A. Aveni, Lake Oswego, OR (US); Martine I. V. Mientjes, Beaverton, OR (US); Kelly McKean, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 465 days.

(21) Appl. No.: 12/949,075

(22) Filed: Nov. 18, 2010

(65) Prior Publication Data

US 2012/0124864 A1 May 24, 2012

(51) Int. Cl.
*A43B 23/26* (2006.01)
*A43B 7/14* (2006.01)

(52) U.S. Cl.
USPC ..... 36/54; 36/88

(58) Field of Classification Search
USPC ..... 36/45, 54, 71, 88
See application file for complete search history.

(56) References Cited

U.S. PATENT DOCUMENTS

| | | | | |
|---|---|---|---|---|
| 1,753,415 | A * | 4/1930 | Hepburn | 36/54 |
| 3,076,274 | A | 2/1963 | Schlecht | |
| 3,284,931 | A | 11/1966 | Dassler | |
| 3,413,736 | A | 12/1968 | Spiteri | |
| 4,458,429 | A | 7/1984 | Schmid | |
| 4,509,276 | A | 4/1985 | Bourque | |
| 4,559,723 | A | 12/1985 | Hamy et al. | |
| 4,835,885 | A * | 6/1989 | Hoshizaki et al. | 36/115 |
| 4,920,666 | A * | 5/1990 | Marega | 36/117.1 |
| 5,050,319 | A | 9/1991 | Perotto et al. | |
| 5,158,767 | A | 10/1992 | Cohen et al. | |
| 5,265,353 | A * | 11/1993 | Marega et al. | 36/54 |
| 5,955,159 | A * | 9/1999 | Allen et al. | 428/34.1 |
| 6,094,841 | A * | 8/2000 | Adams | 36/99 |
| 6,128,837 | A | 10/2000 | Huang | |
| 6,234,988 | B1 | 5/2001 | Brother et al. | |
| 6,237,253 | B1 * | 5/2001 | Feuerecker | 36/54 |
| 6,360,454 | B1 | 3/2002 | Dachgruber et al. | |
| 6,460,197 | B2 | 10/2002 | Huang | |
| 6,993,860 | B2 * | 2/2006 | Bettiol | 36/54 |
| D550,948 | S | 9/2007 | Pelsue | |
| 7,325,813 | B2 | 2/2008 | Bock | |
| 7,562,470 | B2 | 7/2009 | Keen | |
| 2002/0144434 | A1 * | 10/2002 | Farys et al. | 36/54 |
| 2009/0071041 | A1 | 3/2009 | Hooper | |
| 2009/0158504 | A1 | 6/2009 | Sparrow et al. | |

FOREIGN PATENT DOCUMENTS

| | | |
|---|---|---|
| FR | 2783678 | 3/2000 |

* cited by examiner

*Primary Examiner* — Jila M Mohandesi
*Assistant Examiner* — Sharon M Prange
(74) *Attorney, Agent, or Firm* — Plumsea Law Group, LLC

(57) ABSTRACT

An article of footwear includes a tongue. The tongue includes a medial portion, a lateral portion, a central portion, a top portion and an upper perimeter portion. The medial portion and the top portion have similar thicknesses, which are greater than the thicknesses of the lateral portion, the central portion and the upper perimeter portion. The central portion is the thinnest portion of the tongue. Each portion of the tongue corresponds to a different pressure zone along a foot in order to provide differential cushioning and support against pressure applied by a fastening system.

20 Claims, 10 Drawing Sheets

ARTICLE OF FOOTWEAR WITH TONGUE OF VARYING THICKNESS

BACKGROUND

The current embodiment relates generally to footwear, and in particular a tongue for an article of footwear.

Articles of footwear can include fastening systems such as laces, straps and zippers. Laces are generally attached to the top of an upper, and help to tighten an opening around a foot. Typically, a tongue is provided along the upper, which rests between a foot and the laces. The tongue can help in adjusting the lacing system. The tongue can act to cover the top of the foot in the region of the opening.

SUMMARY

In one aspect, an article of footwear includes an upper, the upper including an opening and a fastening region associated with the opening. The article of footwear also includes a tongue, the tongue including a first portion, a second portion and a third portion. The first portion has a first thickness, the second portion has a second thickness and the third portion has a third thickness. The first thickness is substantially greater than the second thickness and the second thickness is substantially greater than the third thickness.

In another aspect, an article of footwear includes an upper, the upper including an opening and a fastening region associated with the opening. The article also includes a tongue, the tongue including a central portion and an outer portion extending between the central portion and an edge of the tongue. The central portion has a first thickness and the outer portion has a second thickness. The second thickness is substantially different than the first thickness.

In another aspect, an article of footwear includes an upper, the upper including an opening and a fastening region associated with the opening. The article also includes a tongue, the tongue including a medial portion and a lateral portion. The medial portion has a first thickness and the lateral portion has a second thickness. The first thickness is substantially different from the second thickness.

Other systems, methods, features and advantages will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
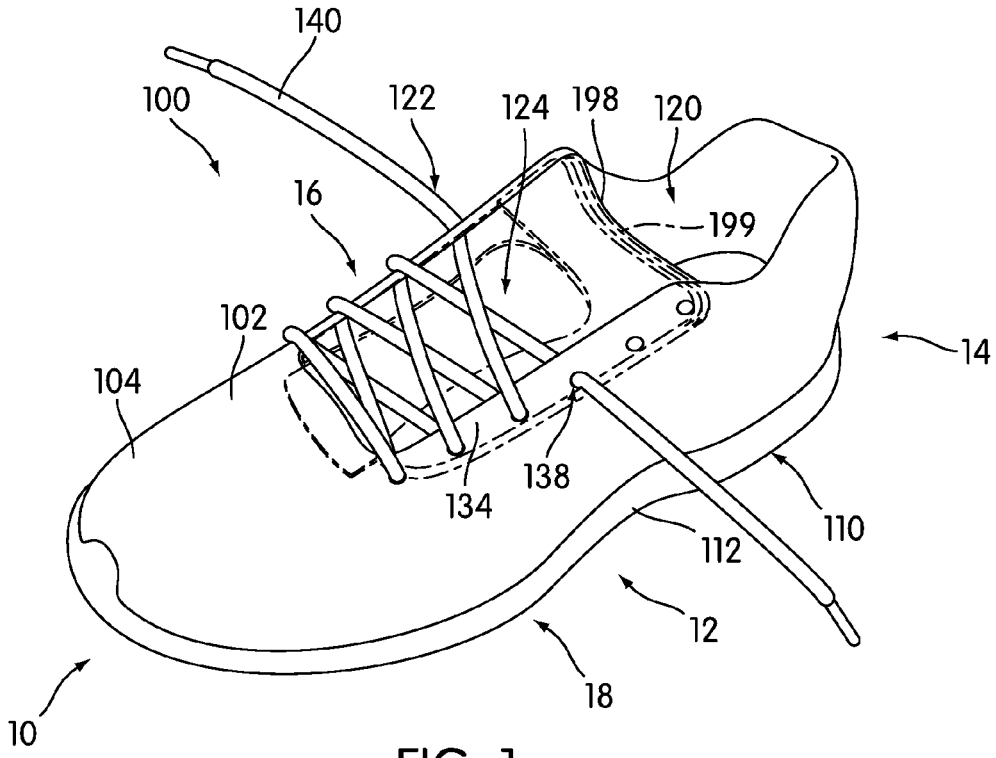
FIG. 1 is an isometric view of an embodiment of an article of footwear including a tongue.
Figure 2:
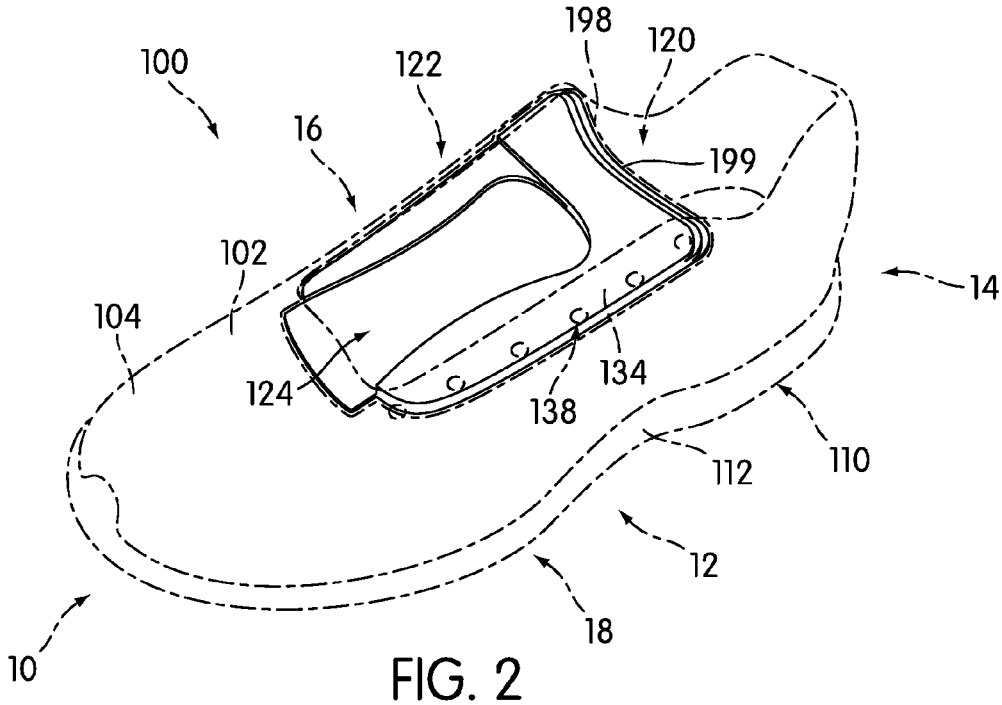
FIG. 2 is an isometric view of an embodiment of an article of footwear including a tongue, in which the upper and sole are shown in phantom.
Figure 3:
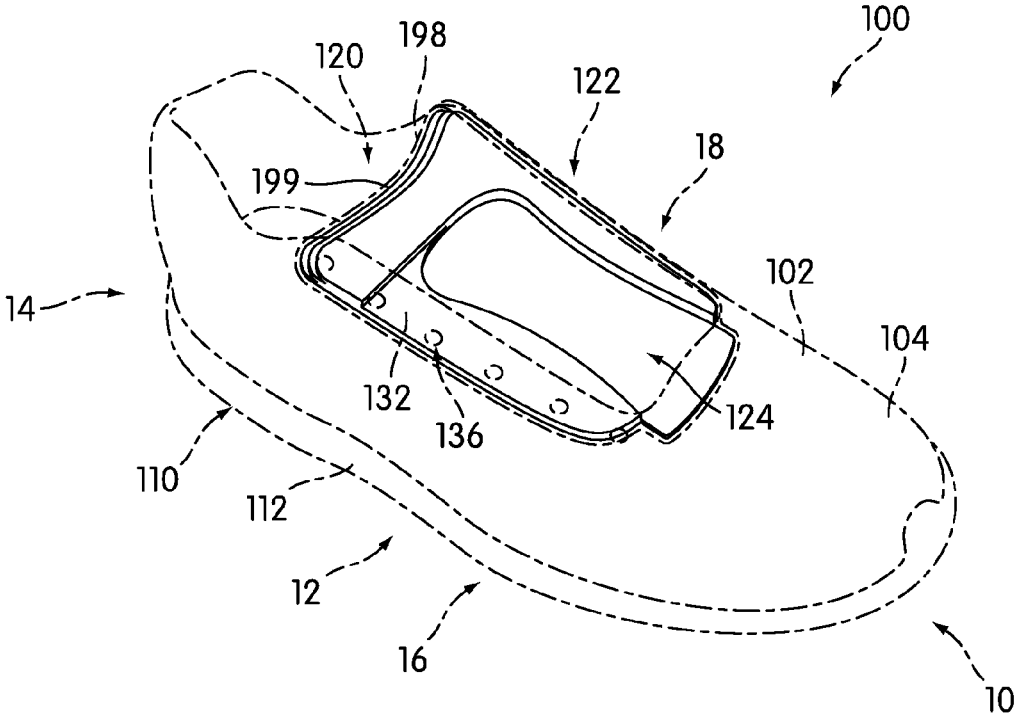
FIG. 3 is an isometric view of an embodiment of an article of footwear including a tongue, in which the upper and sole are shown in phantom.

FIGS. 1 through 3 illustrate views of an embodiment of an article of footwear 100. For clarity, the following detailed description discusses an exemplary embodiment, in the form of a sports shoe, but it should be noted that the present embodiments could take the form of any article of footwear including, but not limited to: hiking boots, soccer shoes, football shoes, sneakers, rugby shoes, basketball shoes, baseball shoes as well as other kinds of shoes. Articles of footwear may also take the form of any non-athletic shoe, including, but not limited to: dress shoes, loafers, sandals, and boots. An individual skilled in the relevant art will appreciate, therefore, that the concepts disclosed herein apply to a wide variety of footwear styles, in addition to the specific style discussed in the following material and depicted in the accompanying figures. As shown in FIGS. 1 through 3, article of footwear 100, also referred to simply as article 100, is intended to be used with a right foot; however, it should be understood that the following description may equally apply to a mirror image of article of footwear 100 that is intended for use with a left foot.

Referring to FIGS. 1 through 3, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves. In addition, forefoot portion 10, midfoot portion 12 and heel portion 14, as well as lateral side 16 and medial side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be applied to individual components of an article, such as an upper and/or a sole structure.

Article 100 can include upper 102 and sole structure 110. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional. In an exemplary embodiment, sole structure 110 may include midsole 112.

In some cases, midsole 112 may be attached directly to upper 102. In other cases, midsole 112 may be attached to a sockliner associated with upper 102. In different embodiments, midsole 112 may have different material characteristics to provide various levels of comfort, cushioning and/or shock absorption. Examples of different materials that could be used for midsole 112 include, but are not limited to: foam, rubber, plastic, polymers, as well as any other kinds of materials.

In some cases, sole structure 110 can also include an outsole. The outsole may be configured to provide traction for sole structure 110 and article 100. An outsole can include one or more tread elements and/or ground penetrating members such as cleats. The outsole can have different material characteristics to provide varying levels of traction with a ground surface. Examples of different materials that could be used for an outsole include, but are not limited to: plastic, rubber, polymers as well as any other kinds of materials that are both durable and wear resistant.

In some embodiments, upper 102 further includes an opening 120 at the heel portion 14 for inserting a wearer's foot into article 100, and a fastening region 122. Opening 120 may be limited to the heel portion 14 of article 100 or may extend along the top of upper 102 into, and including, fastening region 122. Thus, in one embodiment upper 102 may be integrated with fastening region 122. In another embodiment fastening region 122 may be separately affixed to upper 102. Fastening region 122 may be situated along the midfoot portion 12 of upper 102 as shown in FIGS. 1-3, or may be situated at other parts of article 100, as would be apparent to those of skill in the art.

In some embodiments, fastening region 122 may further include lateral fastening portion 132 and medial fastening portion 134. Lateral fastening portion 132 may be disposed along a lateral edge of fastening region 122. Medial fastening portion 134 may be disposed along a medial edge of fastening region 122. Moreover, lateral fastening portion 132 may include first set of eyelets 136 for receiving portions of a lace or other fastener. Likewise, medial fastening portion 134 may include second set of eyelets 138 for receiving portions of a lace or other fastener.

Fastening region 122 may include a fastening system for tightening article 100 around a wearer's foot. Examples of different fastening systems that could be used within fastening region 122 include, but are not limited to: lacing systems, strap systems as well as any other kinds of systems. Thus, fastening region 122 may be configured in a variety of ways to accommodate different types of fastening systems. In some embodiments, fastening region 122 may be provided with laces 140. Laces 140 could be any type of laces configured for use with an article of footwear.

In one embodiment, laces 140 may be configured to engage with fastening region 122. In some cases, laces 140 may be inserted through first set of eyelets 136 and second set of eyelets 138 in an alternating manner. This arrangement allows fastening region 122, and upper 102, to be tightened by pulling on laces 140.

Upper 102 may further include a separate provision, such as tongue 124, which may be attached to upper 102 under fastening region 122. In some cases, tongue 124 may be rigidly attached only at the toe end 104 of upper 102. In other cases, tongue 124 may be additionally rigidly attached along a portion of the fastening region 122. In still other cases, tongue 124 may be attached at the toe end 104 and along the entirety of fastening region 122. Depending on how tongue 124 is attached to upper 102, opening 120 may be of varying sizes when tongue 124 is lifted up from fastening region 122. In addition, tongue 124 may be configured as a portion of upper 102.

Tongue 124 may comprise outer layer 198 and inner layer 199. Outer layer 198 may act as a cover for inner layer 199. Inner layer 199 may function as a cushioning layer in some cases, in order to provide cushioning along the top of a foot.

In some embodiments, outer layer 198 cover could comprise a substantially similar material to the material used in constructing the upper. Moreover, outer layer 198 and inner layer 199 could be joined using any methods including, but not limited to: stitching, adhesives as well as any other methods of joining a cover to a component.

For purposes of clarity, outer layer 198 is only shown in FIGS. 1 through 3. In particular, only inner layer 199 of tongue 124 is shown in the remaining Figures to illustrate the structure of inner layer 199. In other embodiments, tongue 124 may not comprise an outer layer and may comprise a single layer of material instead.

Figure 8:
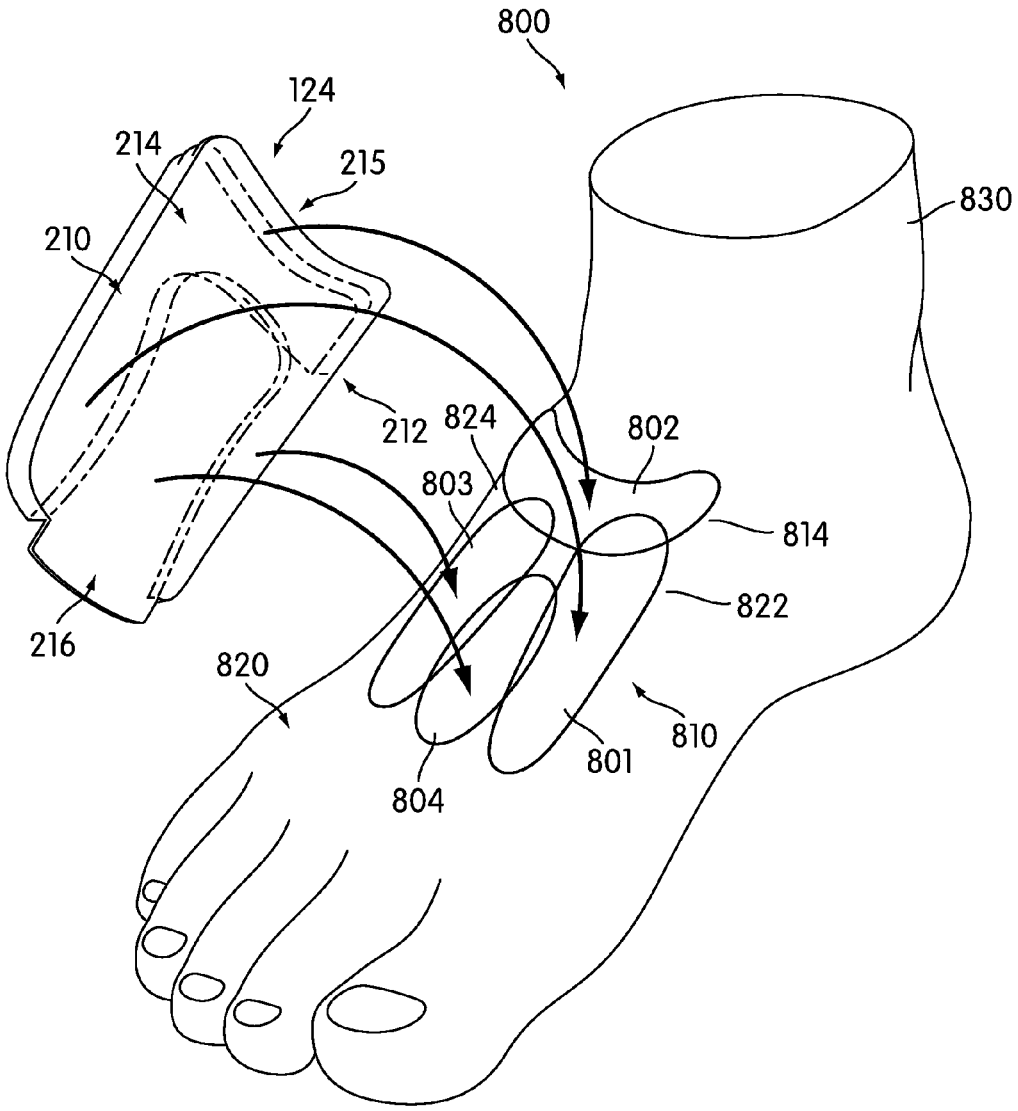
FIG. 8 is an isometric view of an embodiment of a tongue in which various regions of the tongue are in correspondence with various pressure zones on a foot.
Figure 9:
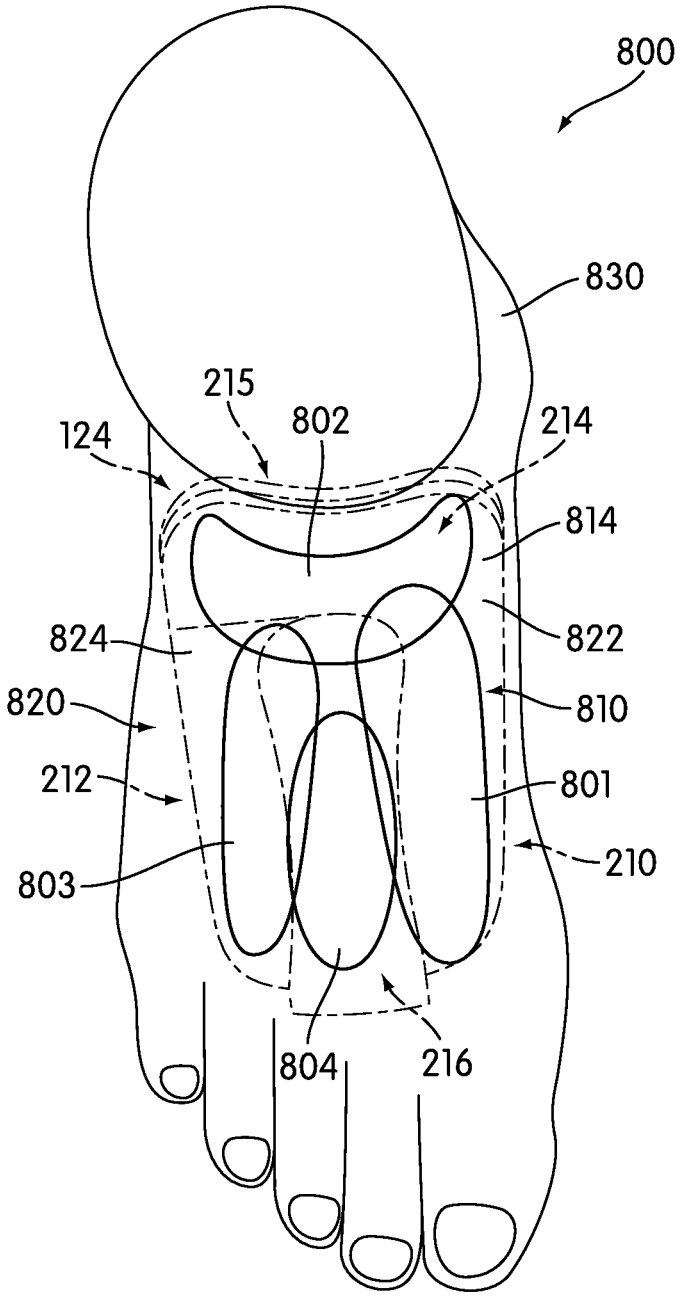
FIG. 9 is a top down view of an embodiment of a tongue in which various regions of the tongue are in correspondence with various pressure zones on a foot.

As a fastening region is tightened by a fastening system, different portions of the fastening system may apply pressure to regions of a foot. For example, in embodiments where laces are used, as the laces are tightened, the tension applied to the lateral and medial edges of the fastening region may cause increased pressure along portions of a foot. In some cases, the pressure may vary along different portions of a foot, including portions directly adjacent to the fastening region. A particular example of pressure distribution over various portions of a foot are shown in FIGS. 8 and 9 and discussed in detail below.

An article of footwear can include provisions for reducing pressure that occurs along a fastening region when the upper is tightened. In some embodiments, a tongue may be used to cushion portions of a foot that may experience pressure that occurs along the fastening region. In embodiments where different amounts of pressure occur over different parts of a foot, a tongue can provide differential cushioning in order to provide the most cushioning in regions where the greatest pressure occurs, and to provide the least cushioning in regions where the least pressure occurs. This allows the tongue to facilitate comfort and also maintain flexibility along portions that are not associated with high pressure regions.

Figure 4:
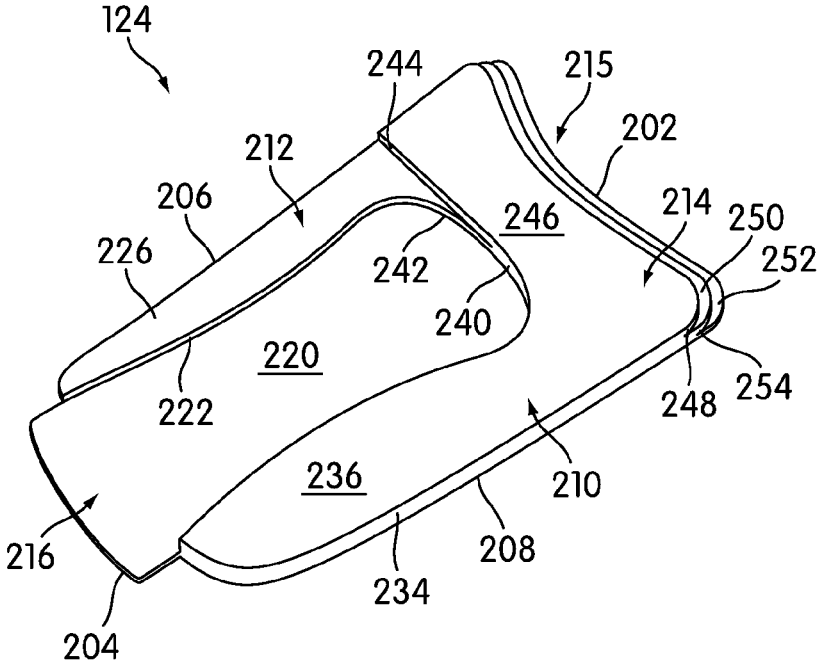
FIG. 4 is an isometric view of an embodiment of a tongue for an article of footwear.
Figure 5:
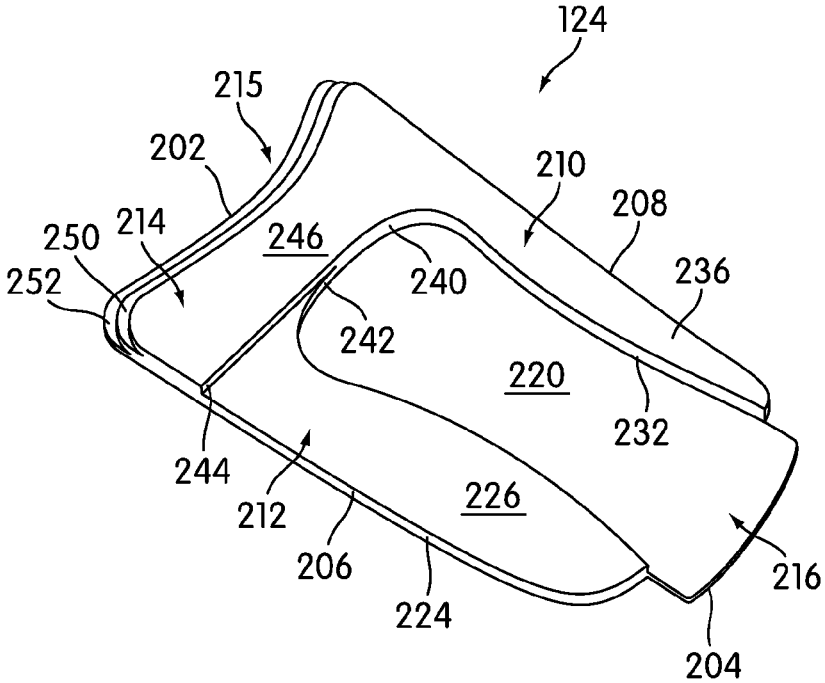
FIG. 5 is an isometric view of an embodiment of a tongue for an article of footwear.

FIGS. 4 and 5 illustrate isolated isometric views of an embodiment of tongue 124. Tongue 124 is bounded by proximal edge 202, distal edge 204, lateral edge 206 and medial edge 208. Moreover, tongue 124 comprises distinct portions with varying physical characteristics. In particular, tongue 124 includes medial portion 210, lateral portion 212, top portion 214 and upper perimeter portion 215. These portions further bound central portion 216, which is disposed between medial portion 210 and lateral portion 212. Central portion 216 is also distal to top portion 214. In particular, each of medial portion 210, lateral portion 212 and top portion 214 comprise outer portions disposed outwardly of central portion 216.

Each portion of tongue 124 is associated with various surfaces and sidewalls of tongue 124. In some embodiments, central portion 216 includes central outer surface 220. In some embodiments, lateral portion 212 may be raised above central portion 216. In one embodiment, lateral portion 212 includes first interior sidewall 222 and lateral sidewall 224. In addition, lateral portion 212 includes lateral outer surface 226. Likewise, medial portion 210 may be raised above central portion 216. In one embodiment, medial portion 210 includes second interior sidewall 232 and medial sidewall 234. In addition, medial portion 210 includes medial outer surface 236.

In some embodiments, top portion 214 may be raised above central portion 216. In one embodiment, top portion 214 may include third interior sidewall 240 and proximal sidewall 248. In some cases, third interior sidewall 240 is continuous with second interior sidewall 232. Moreover, in some cases, lower portion 242 of third interior sidewall 240 may be continuous with first interior sidewall 222, while upper portion 244 of third interior sidewall 240 may extend to lateral edge 206. Top portion 214 may also include top outer surface 246. In some cases, top outer surface 246 may be substantially continuous with medial outer surface 236. In other cases, however, top outer surface 246 may not be continuous with medial outer surface 236.

In some embodiments, upper perimeter portion 215 includes first perimeter surface 250 and second perimeter surface 252. In some cases, first perimeter surface 250 and second perimeter surface 252 may be stepped surfaces. In some cases, first perimeter surface 250 may be disposed below top outer surface 246. In one embodiment, first perimeter surface 250 is separated from top outer surface 246 by proximal sidewall 248. Also, second perimeter surface 252 may be disposed below first perimeter surface 250. In one embodiment, second perimeter surface 252 is separate from first perimeter surface 250 by sidewall 254.

In different embodiments, the geometries of one or more portions of tongue 124 could vary. In some embodiments, central outer surface 220, lateral outer surface 226, medial outer surface 236 and top outer surface 246 may be substantially flat surfaces. However, in other embodiments, one or more of these surfaces could be curved. Moreover, the curvature could be convex or concave or could vary between convex and concave. In some embodiments, interior sidewalls could be straight or curved. In some cases, first interior sidewall 222 and second interior sidewall 232 may be curved sidewalls, which provide curved interior edges for lateral portion 212 and medial portion 210, respectively. Likewise, the shape of proximal sidewall 248 could be straight or curved. In one embodiment, proximal sidewall 248 has a curved shape.

Generally, when viewed from above, medial portion 210, lateral portion 212 and top portion 214 comprise an approximately U-shaped portion that bounds central portion 216. Also, it is possible to consider the combined shape of medial portion 210 and top portion 214 as comprising an approximately L-shaped portion that bounds the upper and medial sides of central portion 216. However, it will be understood that these shapes could be varied in other embodiments by varying the shapes of the various sidewalls and outer surfaces associated with each portion.

In different embodiments, the thicknesses of one or more portions of a tongue can vary. In some embodiments, the thickness of a portion may vary according to the amount of cushioning required. In particular, regions of increased thickness may provide increased cushioning, while regions of reduced thickness may provide less cushioning. Moreover, the thickest regions of a tongue may be associated with regions of a foot that receive the greatest pressure from a tightened fastening system.

Figure 6:
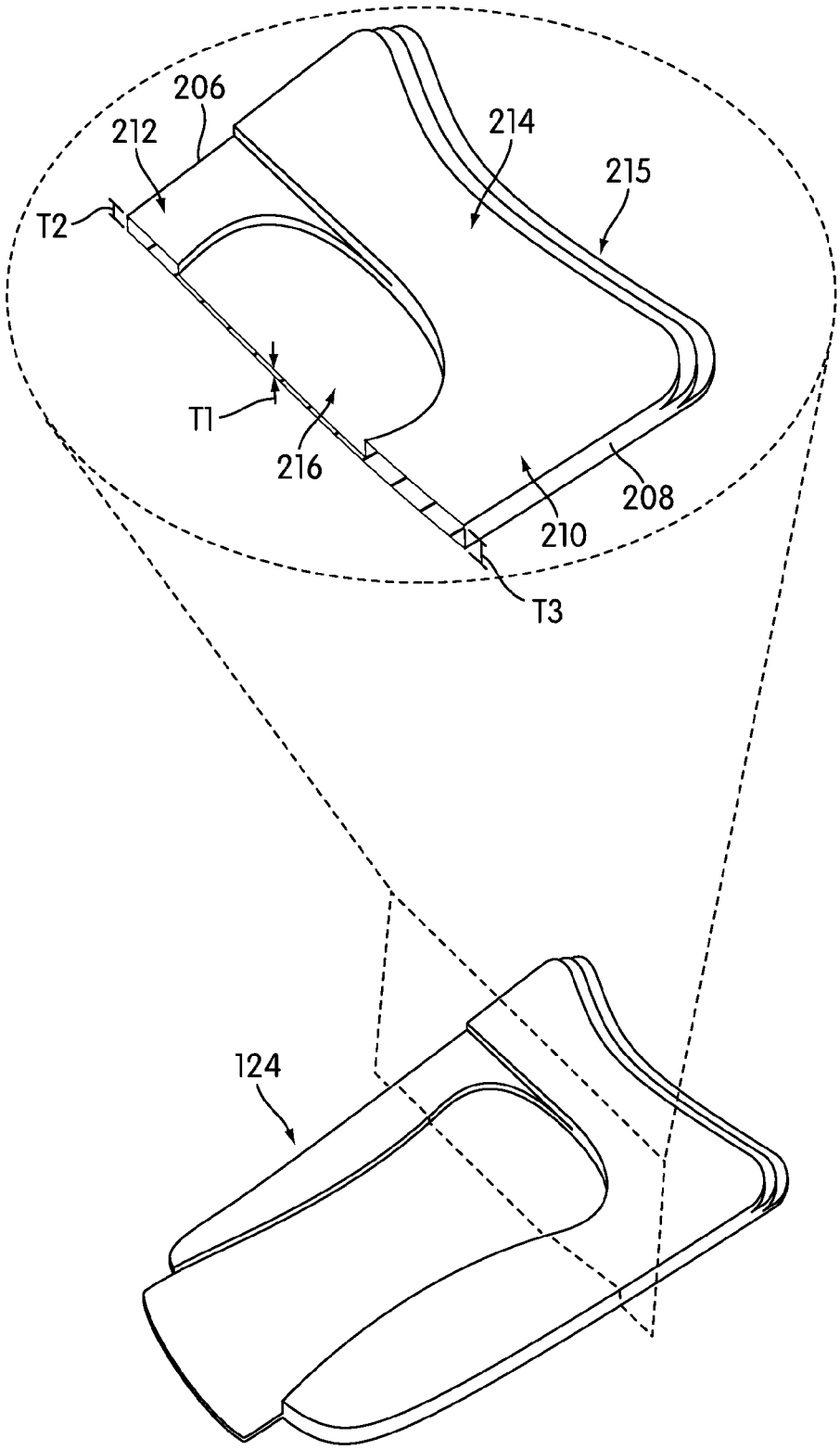
FIG. 6 is an isometric view of an embodiment of a tongue in which the thicknesses of various portions of the tongue can be seen.
Figure 7:
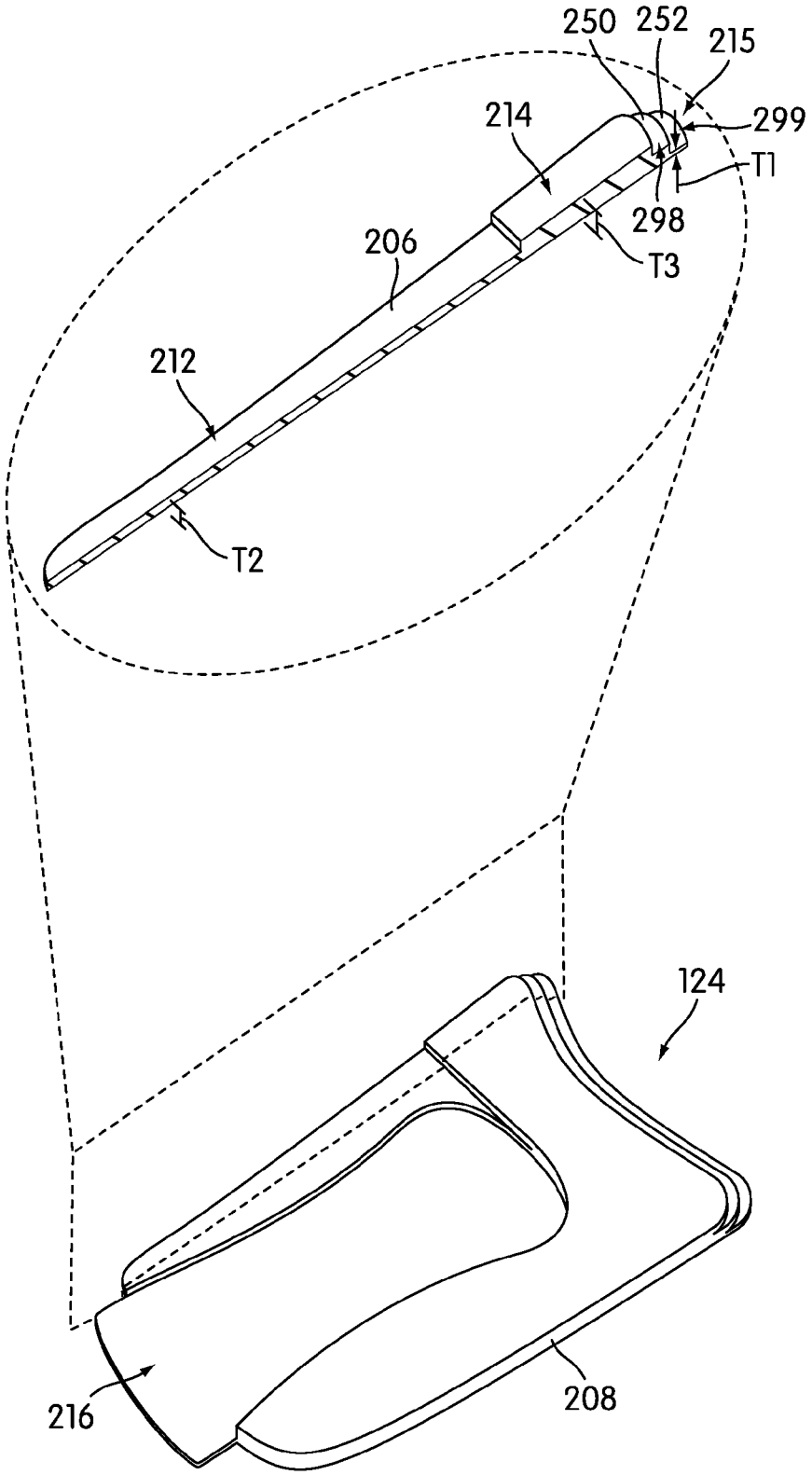
FIG. 7 is an isometric view of an embodiment of a tongue in which the thicknesses of various portions of the tongue can be seen.

FIGS. 6 and 7 illustrate isometric views of tongue 124 with an enlarged cut-away view of tongue 124. Referring to FIG. 6, in some embodiments, the thickness of tongue 124 may vary in a lateral direction along tongue 124. In one embodiment, central portion 216 may be associated with thickness T1, lateral portion 212 may be associated with thickness T2 and medial portion 210 may be associated with thickness T3. In some embodiments, thickness T1, thickness T2 and thickness T3 may be substantially different from one another. In other embodiments, thickness T1, thickness T2 and thickness T3 may be substantially similar. In still other embodiments, two of these thicknesses may be substantially similar while a third thickness may be substantially different from the other two thickness.

In one embodiment, thickness T1 is substantially less than thickness T2. Also, thickness T2 is substantially less than thickness T3. In other words, medial portion 210 is the thickest portion of medial portion 210, lateral portion 212 and central portion 216. Likewise, central portion 216 is the thinnest portion of medial portion 210, lateral portion 212 and central portion 216. Moreover, the thickness of lateral portion 212 has a thickness between the thicknesses of medial portion 210 and central portion 216.

Referring to FIG. 7, in some embodiments, the thickness of tongue 124 may vary in a longitudinal direction along tongue 124. As previously discussed and shown in FIG. 6, lateral portion 212 may have thickness T2. In addition, top portion 214 may have thickness T3, which is approximately equal to the thickness of medial portion 210. In addition, upper perimeter portion 215 may have thickness T1 at first portion 299, which is a portion of upper perimeter portion 215 associated with second perimeter surface 252. Also, upper perimeter portion 215 may have thickness T2 at second portion 298, which is a portion of upper perimeter portion 215 associated with first perimeter surface 250. In other words, the thickness of first portion 299 may be substantially similar to the thickness of central portion 216. Also, the thickness of second portion 298 may be substantially similar to the thickness of lateral portion 212.

Using this configuration, top portion 214 and medial portion 210 may have substantially similar thicknesses. With this arrangement, top portion 214 and medial portion 210 may provide substantially similar amounts of cushioning. Likewise, central portion 216 and first portion 299 of upper perimeter portion 215 may have substantially similar thicknesses. With this arrangement, central portion 216 and first portion 298 may provide substantially similar amounts of cushioning. Additionally, lateral portion 212 and second portion 298 of upper perimeter portion 215 may have substantially similar thicknesses. With this arrangement, lateral portion 212 and second portion 298 may provide substantially similar amounts of cushioning.

By varying the thicknesses of different portions, tongue 124 can be configured to provide different levels of cushioning. In embodiments where tongue 124 is made of a substantially rigid material like plastic or hard rubber, the thickest regions of tongue 124 (such as top portion 214 and medial portion 210) may be the most rigid portions and so are capable of providing increased support against higher pressures from a fastening system. In embodiments where tongue 124 is made of a cushioning material such as foam, the thickest regions of tongue 124 may comprise the greatest amount of cushioning material and so are capable of absorbing the higher pressures from a fastening system. In contrast, the thinnest regions of tongue 124 (such as central portion 216 and first portion 299 of upper perimeter portion 215) may be configured for maximum flexibility since these regions experience the lowest pressure from a fastening system. Likewise, the regions of intermediate thickness (such as lateral portion 212 and second portion 299 of upper perimeter portion 215) may be configured to provide an intermediate level of cushioning and flexibility, since these regions may experience pressures from a fastening system that are substantially less than the higher pressures applied to other regions.

In some embodiments, the thickness of each portion can be approximately constant. In other embodiments, however, the thickness of each portion can be variable. For example, in some cases, the thickness of lateral portion 212 could increase from lateral edge 206 towards central portion 216. As another example, in some cases, the thickness of medial portion 210 could increase from medial edge 208 towards central portion 216. It will be understood that the variation in the thickness of each portion could be regular or irregular. In embodiments where the thickness of a portion varies, the thickness may be characterized by an average thickness. For example, in some cases, thickness T1 (which characterizes the thickness of central portion 216 and first portion 299 of upper perimeter portion 215) may be an average thickness. Likewise, thickness T2 (which characterizes the thickness of lateral portion 212 and second portion 298 of upper perimeter portion 215) may be an average thickness. Furthermore, thickness T3 (which characterizes the thickness of top portion 214 and medial portion 210) may be an average thickness. In such embodiments, the average thickness of top portion 214 and medial portion 210 may be greater than the thickness of the remaining portions. Likewise, in such cases, the average thickness of central portion 216 and first portion 299 of upper perimeter portion 215 may be less than the thickness of the remaining portions. Finally, in such cases, the thickness of lateral portion 212 and second portion 298 of upper perimeter portion 215 may be between the thicknesses of the remaining portions. It will be understood that throughout the remainder of this detailed description and in the claims the term thickness could characterize the thickness of an entire portion (when the thickness of the portion is approximately constant), or an average thickness of a portion.

FIGS. 8 and 9 illustrate views of tongue 124 in relationship to foot 800. Foot 800 may comprise various different pressure zones or regions where pressure can build up on the foot when a fastening system is tightened. In this case, foot 800 includes first pressure zone 801, second pressure zone 802, third pressure zone 803 and fourth pressure zone 804, which may be collectively referred to as pressure zones 810. Pressure zones 810 are generally associated with top portion 820 of foot 800, as well as the medial and lateral sides adjacent to the top of the foot. In particular, first zone 801 is disposed on medial side 822 of top portion 820 and third zone 803 is associated with lateral side 824 of top portion 820. In addition, second pressure zone 802 is disposed on top portion 814, and may be adjacent to ankle 830. Fourth pressure zone 804 is disposed centrally within top portion 820, between medial side 822 and lateral side 824.

Each zone may be associated with different amounts of pressure when a fastening system is tightened. In some cases, first pressure zone 801 and second pressure zone 802 are the highest pressure zones, due to the pressure applied along the medial region of the fastening region and the top of the fastening region. In some cases, fourth pressure zone 804 may be associated with the lowest pressures. Finally, third pressure zone 803 may be associated with intermediate pressures that are between the highest pressures (along first pressure zone 801 and second pressure zone 802) and the lowest pressures (along fourth pressure zone 804).

In order to alleviate the pressure applied in pressure zones 810, tongue 124 may provide cushioning between top portion 820 of foot 800 and a fastening system. In some embodiments, tongue 124 is configured to provide differential cushioning using portions of varying thicknesses. In the current embodiment, medial portion 210 is configured to be aligned with first pressure zone 801 when foot 800 is inserted into article 100. Top portion 214 is configured to be aligned with second pressure zone 802. With this arrangement, the thickest portions of tongue 124 may be disposed on the highest pressure zones. In addition, lateral portion 212 is configured to be aligned with third pressure zone 803. Central portion 216 is configured to be aligned with fourth pressure zone 804. With this arrangement, the portions of intermediate thickness and lowest thickness may be disposed on the zones of intermediate pressure and lowest pressure, respectively. Moreover, upper perimeter portion 215 may be associated with an area above second pressure zone 802, which is an area that experiences little or no pressure from a fastening system. Furthermore, since the thickness of upper perimeter portion 215 varies from first portion 299 to second portion 298 (see FIG. 7) upper perimeter portion 215 provides a transition from intermediate to low cushioning just outside of second pressure zone 802. The overall configuration of tongue 124 may help to evenly distribute instep lacing pressure.

The previous embodiments discuss exemplary configurations for a tongue. In other embodiments, the thicknesses of one or more portions of a tongue could be varied in any other manner. For example, in some cases, the thicknesses of a lateral portion and a medial portion of a tongue could be substantially similar.

Figure 10:
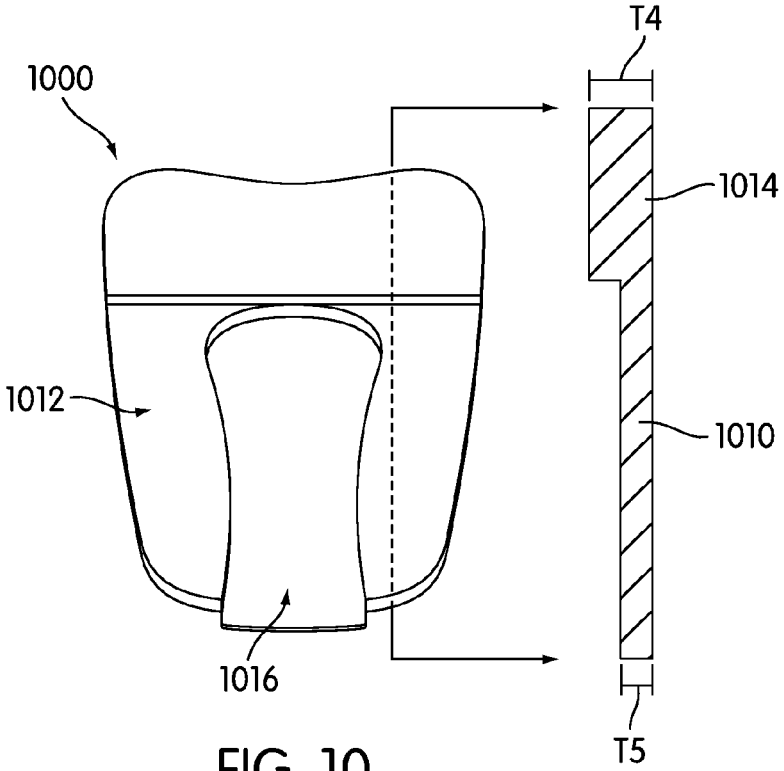
FIG. 10 is a schematic view of an embodiment of a tongue in which the thickness of the tongue is greatest at the top portion.
Figure 11:
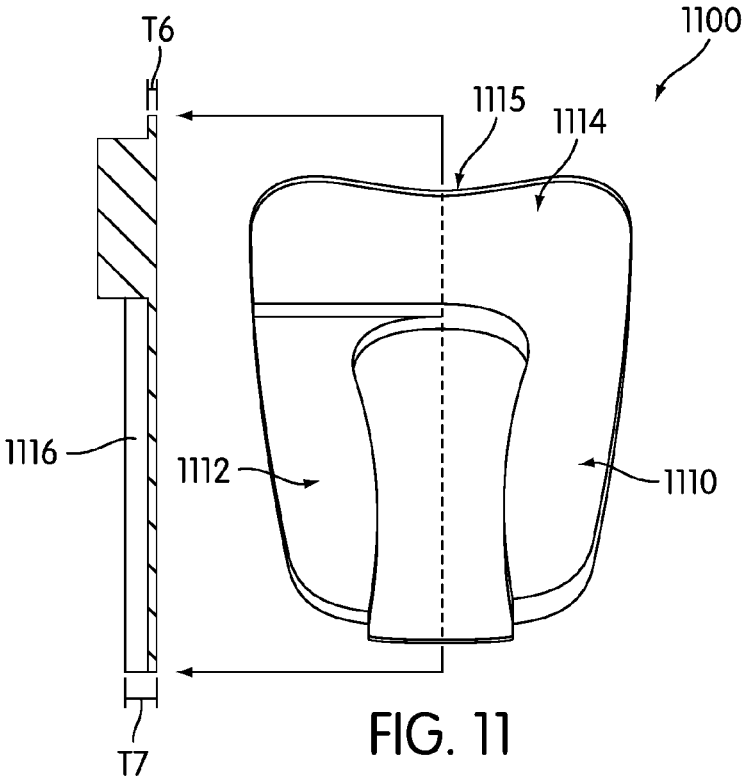
FIG. 11 is a schematic view of an embodiment of a tongue in which the thickness of the tongue varies along the top portion.

FIGS. 10 and 11 illustrate embodiments for alternative configurations of a tongue (note that reference numbers carry over for like parts throughout the detailed description and the figures). Referring to FIG. 10, tongue 1000 comprises medial portion 1010, lateral portion 1012, top portion 1014 and central portion 1016. In this case, top portion 1014 has thickness T4 and medial portion 1010 has thickness T5. In some cases, thickness T5 may be substantially less than thickness T4. In other words, top portion 1014 could be thicker than medial portion 1010, which may allow for a greater amount of cushioning at top portion 1014. Moreover, in some cases, lateral portion 1012 and medial portion 1010 could be configured with similar thicknesses. In other cases, lateral portion 1012 and medial portion 1010 could be configured with substantially different thicknesses.

In some embodiments, a central portion and an upper perimeter portion could have substantially different thicknesses. Referring to FIG. 11, tongue 1100 comprises medial portion 1110, lateral portion 1112, top portion 1114, central portion 1116 and upper perimeter portion 1115. In this case, upper perimeter portion 1115 has thickness T6 and central portion 1116 has thickness T7. In this case, thickness T6 is substantially less than thickness T7. This arrangement may allow for a minimal amount of cushioning in the region above second pressure zone 802 (see FIGS. 8 and 9) since there is little to no pressure applied at this region.

Figure 12:
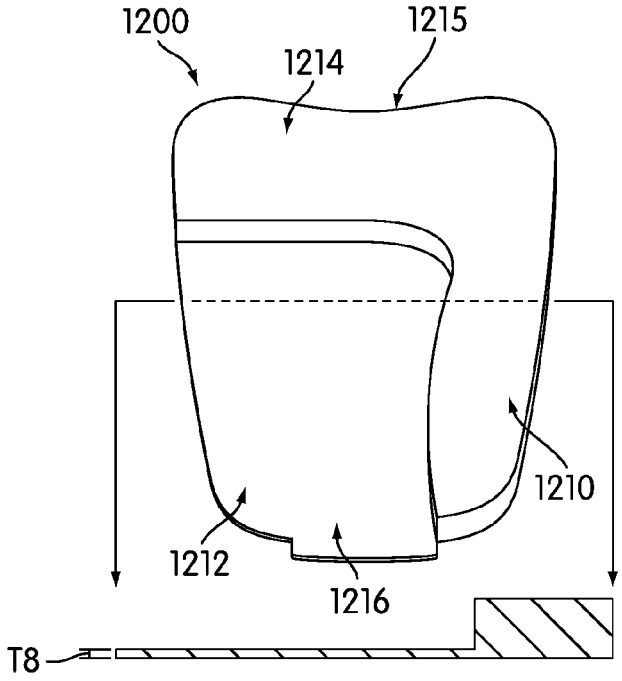
FIG. 12 is a schematic view of an embodiment of a tongue in which the thickness of the tongue is greatest on a medial side.

In some embodiments, a lateral portion and a central portion could have substantially similar thicknesses. Referring to FIG. 12, tongue 1200 comprises medial portion 1210, lateral portion 1212, top portion 1214, central portion 1216 and upper perimeter portion 1215. In this case, lateral portion 1212 and central portion 1216 have approximately the same thickness T8. This arrangement allows for an even amount of cushioning to be applied to third pressure zone 803 and fourth pressure zone 804 (see FIGS. 8 and 9), which are both lower pressure zones.

Figure 13:
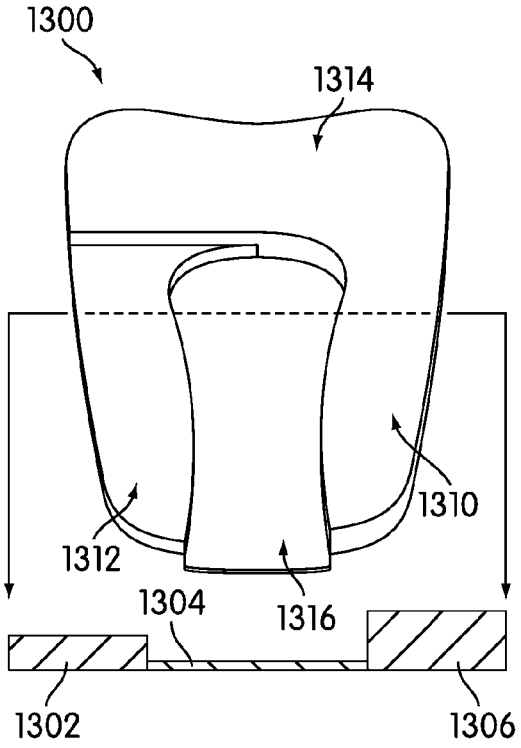
FIG. 13 is a schematic view of an embodiment of a tongue in which regions of different thickness comprise distinct components.

Generally, a tongue with different thicknesses could be manufactured in any manner. In some embodiments, portions with different thicknesses could be formed separately and assembled together. For example, different portions could be molded separately and then joined after the molding process. An example of a tongue with three different material portions is shown in FIG. 13. Referring to FIG. 13, tongue 1300 comprises first material portion 1302, second material portion 1304 and third material portion 1306. Each material portion is associated with a distinct portion of tongue 1300. In this case, first material portion 1302 makes up lateral portion 1312, second material portion 1304 makes up central portion 1316 and third material portion 1306 makes up medial portion 1310 and top portion 1314. Using this arrangement, each portion could be made with distinct material properties.

Figure 14:
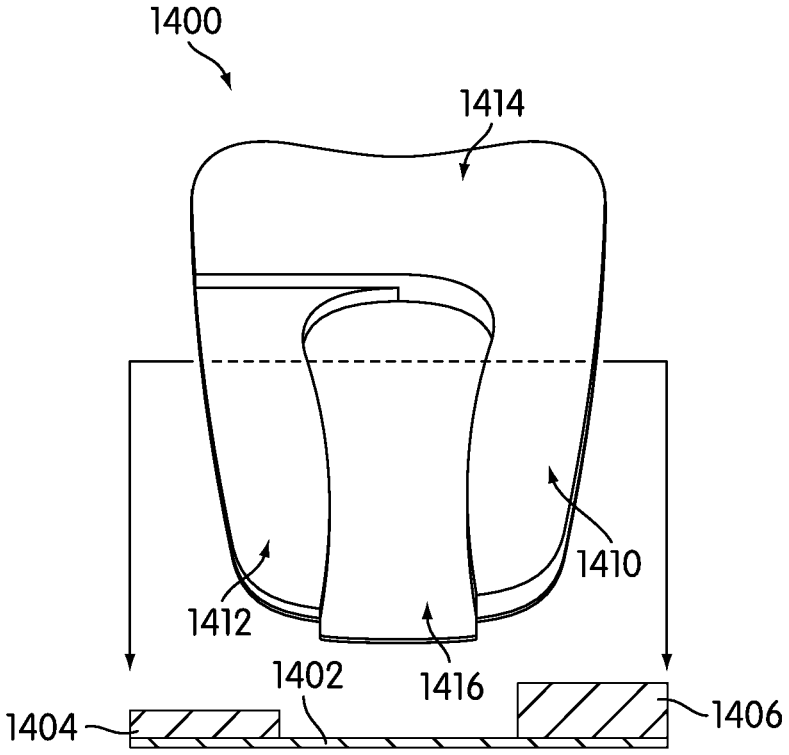
FIG. 14 is a schematic view of an embodiment of a tongue in which the tongue comprises a base layer and cushioning layers.

In other embodiments, a tongue could comprise a single base layer and portions of different thicknesses could be formed by applying material portions of different thicknesses to the base layer. FIG. 14 illustrates an example of tongue 1400, which comprises base layer 1402, first cushioning layer 1404 and second cushioning layer 1406. First cushioning layer 1404 is associated with lateral portion 1412, and comprises a slightly greater thickness than base layer 1402. Second cushioning layer 1406 is associated with medial portion 1410 and top portion 1414 and comprises a greater thickness than both base layer 1402 and first cushioning layer 1404. Moreover, base layer 1402 is associated with central portion 1416, which is the thinnest portion of tongue 1400.

In each of these different embodiments, different material portions could be joined using any method known in the art. These could include joining by adhesives, joining using fasteners, joining during a molding process, soldering, stitching, welding or using any other manner of fastening distinct materials.

In some embodiments, a tongue may be formed of a single material. In some cases, material could be removed from the tongue to form portions of varying thickness. For example, in embodiments where a tongue is made of a plastic material, the tongue could be carved or shaved so that different portions have different thicknesses.

Generally, any materials known in the art for use with footwear can be used with the tongues discussed above. Examples of materials include, but are not limited to: plastic, foam, fabric, canvas, leather, wood, rubber, metal as well as any other materials known in the art. In some embodiments, a tongue could be made using a knit material (such as various yarns or threads). In some cases, a tongue with regions of different thickness could be formed using a knitting process. An example of such a knitting process for forming tongues and other knitted elements is disclosed in Greene, U.S. Pat. No. _____, now U.S. patent application Ser. No. 12/574, 876, filed Oct. 7, 2009, the entirety of which is hereby incorporated by reference. In cases where a tongue is formed using a knitting process, any suitable knitting materials could be used.

Although the current embodiment discusses a tongue used with a lacing system, it will be understood that in other embodiments, a tongue with varying thickness could be used with any type of fastening system that can create pressure. Examples of different fastening systems that could be used with a tongue of variable thickness include, but are not limited to: laces, straps, buttons, snaps, zippers as well as any other kinds of fastening systems. Moreover, it will be understood that the thicknesses of a tongue could be modified in any manner to achieve the desired cushioning properties for any other uses with footwear. In other words, a tongue with a variable thickness could be used in other applications of footwear to achieve cushioning for alleviating pressures due to any types of forces, not just pressure from lacing systems.

While various embodiments of the have been described, the description is intended to be exemplary, rather than limiting and it will be apparent to those of ordinary skill in the art that many more embodiments and implementations are possible. Accordingly, the embodiments are not to be restricted except in light of the attached claims and their equivalents. Also, various modifications and changes may be made within the scope of the attached claims.

We claim:

1. An article of footwear, comprising:

an upper, the upper including an opening and a fastening region associated with the opening; and a tongue, the tongue including a first portion, a second portion and a third portion;

the first portion having a first thickness, the second portion having a second thickness and the third portion having a third thickness;

wherein the first portion is a medial side of the tongue, the second portion is a lateral side of the tongue, and the third portion is a central area of the tongue disposed between and adjacent to the medial side and the lateral side;

wherein the first portion extends substantially the entire length of the medial side of the tongue;

wherein the first portion further is associated with a top portion of the tongue that extends substantially from a medial edge of the tongue to a lateral edge of the tongue, the top portion being disposed closest to an ankle when a foot is inserted into the article of footwear;

wherein the first portion has a substantially consistent thickness; and wherein the first thickness is substantially greater than the second thickness and the second thickness is substantially greater than the third thickness.

2. The article of footwear according to claim 1, wherein the tongue includes an outer layer and an inner layer, and wherein the first portion, the second portion and the third portion are associated with the inner layer.

3. The article of footwear according to claim 1, wherein the second portion extends from the top portion to a lower edge of the lateral side of the tongue.

4. The article of footwear according to claim 3, wherein the second portion has a substantially consistent thickness.

5. The article of footwear according to claim 3, wherein the third portion extends beyond a lower edge of the second portion of the tongue.

6. The article of footwear according to claim 3, wherein the third portion extends beyond a lower edge of the first portion of the tongue.

7. The article of footwear according to claim 1, wherein the tongue further includes an upper perimeter portion disposed between an upper edge of the tongue and the top portion, and wherein a thickness of the upper perimeter portion is different from a thickness of the top portion.

8. The article of footwear according to claim 7, wherein the thickness of the upper perimeter portion is less than the first thickness.

9. An article of footwear, comprising:

an upper, the upper including an opening and a fastening region associated with the opening; and a tongue, the tongue including a central portion and an outer portion extending between the central portion and an edge of the tongue;

the central portion extending to a distal edge of the tongue;

the outer portion comprising a top portion and a lower portion;

the top portion being disposed between an upper edge of the central portion and a proximal end of the tongue;

the lower portion extending from the top portion to a lower edge of the lower portion adjacent a distal end of the tongue;

the top portion being thicker than the lower portion; and the central portion having a first thickness and the lower portion having a second thickness;

wherein the central portion extends further than the lower portion of the outer portion; and wherein the second thickness is substantially greater than the first thickness, and wherein the second thickness is substantially consistent from the top portion to the lower edge of the lower portion.

10. The article of footwear according to claim 9, wherein the top portion extends between a medial edge of the tongue and a lateral edge of the tongue.

11. The article of footwear according to claim 9, wherein the outer portion is disposed between the central portion and a proximal edge of the tongue.

12. The article of footwear according to claim 9, wherein the outer portion is disposed between the central portion and a medial edge of the tongue.

13. The article of footwear according to claim 9, wherein the outer portion is disposed between the central portion and a lateral edge of the tongue.

14. The article of footwear according to claim 9, wherein the central portion is associated with a first pressure zone of a foot and wherein the outer portion is associated with a second pressure zone of the foot and wherein the second pressure zone is a higher pressure zone than the first pressure zone.

15. An article of footwear, comprising:

an upper, the upper including an opening and a fastening region associated with the opening; and a tongue, the tongue including a medial portion and a lateral portion;

the medial portion being disposed on a medial side of the tongue substantially from a proximal end to a distal end of the medial side of the tongue, the lateral portion being disposed on a lateral side of the tongue substantially from a proximal end to a distal end of the lateral side of the tongue;

the medial portion corresponding with a first anatomical feature of the foot, the medial portion having a first thickness that is substantially consistent through an entire length of the medial portion, and the lateral portion corresponding with a second anatomical feature of the foot, the lateral portion having a second thickness that is substantially consistent through an entire length of the lateral portion; and wherein the first thickness is substantially different from the second thickness so that a thickness profile in a medial to lateral direction of the tongue is asymmetric.

16. The article of footwear according to claim 15, wherein the first thickness is substantially greater than the second thickness.

17. The article of footwear according to claim 15, wherein the medial portion is configured to confront a first pressure zone associated with the first anatomical feature and wherein the lateral portion is configured to confront a second pressure zone associated with the second anatomical feature.

18. The article of footwear according to claim 17, wherein the first pressure zone is a higher pressure zone than the second pressure zone.

19. The article of footwear according to claim 15, wherein the tongue further includes a central portion disposed between the medial portion and the lateral portion and wherein the central portion has a third thickness that is less than the first thickness and the second thickness.

20. The article of footwear according to claim 19, wherein the tongue further includes a top portion disposed proximally to the central portion and wherein the top portion has a fourth thickness that is different from the first thickness, the second thickness and the third thickness.

* * * * *